US005108108A

United States Patent [19]

Norman et al.

[11] Patent Number: 5,108,108

[45] Date of Patent: Apr. 28, 1992

[54] TOSSABLE STRATEGY-TYPE GAME WITH PLAYING SURFACE

[75] Inventors: Richard Norman; Sonja Norman, both of Sutton; David Chamberlain, Knowlton, all of Canada

[73] Assignee: Profitable Entertainment Products, Inc., Knowlton, Canada

[21] Appl. No.: 564,110

[22] Filed: Aug. 8, 1990

Related U.S. Application Data

[63] Continuation-in-part of Ser. No. 421,363, Oct. 16, 1989, Pat. No. 4,953,870, which is a continuation of Ser. No. 104,992, Oct. 6, 1987, abandoned.

[51] Int. Cl.[5] ..... A63F 3/00

[52] U.S. Cl. ..... 273/241; 273/287

[58] Field of Search ..... 273/239, 241, 290, 291, 273/280, 281, 346, 287

[56] References Cited

U.S. PATENT DOCUMENTS 3,359,003 12/1967 Kass ..... 273/241

4,456,258 6/1984 Lodrick ..... 273/241

4,671,514 6/1987 Diehl ..... 273/DIG. 30 X

OTHER PUBLICATIONS

Frank Brady, *Games*, "The $100,000 Gambit", Jan.-Feb. 1981, pp. 18-20.

*Primary Examiner*—Edward M. Coven
*Assistant Examiner*—William E. Stoll
*Attorney, Agent, or Firm*—Samuel Meerkreebs

[57] ABSTRACT

A tossable strategy-type game comprising a body adapted to be tossed and caught during play, the body including a playing surface. A plurality of playing pieces are associated with the playing surface, the playing pieces each having attachment means for releasably attaching the playing pieces to the surface with sufficient strength to retain the playing pieces attached to the surface during tossing while enabling the playing pieces to be manually detached from the surface. The strategy-type game, according to the invention, enables players to interact on a common playing surface without the players being forced to remain in close proximity to one another while the game is in progress.

8 Claims, 2 Drawing Sheets

TOSSABLE STRATEGY-TYPE GAME WITH PLAYING SURFACE

CROSS-REFERENCE TO RELATED APPLICATIONS

This is a continuation-in-part application of application Ser. No. 421,363, filed Oct. 16, 1989, Pat. No. 4,953,870, which a continuation of application Ser. No. 104,992, filed Oct. 6, 1987, now abandoned.

BACKGROUND OF THE INVENTION

1. Field of the Invention

The present invention relates to improvements in strategy-type games. More particularly, the invention is directed to a tossable strategy-type game.

2. Description of the Prior Art

Portable strategy-type games are known in the art. U.S. Pat. Nos. 2,282,871, Malbon, May 12, 1942; 3,359,003, Kass, Dec. 19, 1967; 3,822,499, De Vos, July 9, 1974; 3,880,429, Blumenhaus, April 29, 1975; 4,129,303, Flagg, Dec. 12, 1978; 4,225,137, Hebner, Sept. 30, 1980; 4,456,258, Lodrick, June 26, 1984; 4,618,151, Fadner et al, Oct. 21, 1986; and 4,671,514, Wilson-Diehl, June 9, 1987; for instance, disclose examples of portable game playing surfaces on which game pieces may be releasably attached. However, since these playing surfaces are relatively heavy and must be mounted or placed on a support while the game is in progress, the players are forced to remain at or return to the locale of the game to make their moves or study the playing positions.

U.S. Pat. No. 4,225,137 discloses a strategy-type game playing surface that may be handed from player to player during a game, and U.S. Pat. No. 4,456,258 discloses a strategy-type game playing surface that might be able to be tossed during a game though the inventor does not suggest this. Neither, however, is convenient to toss back and forth over any significant distance. Neither has a geometry suitable for tossing and catching, and U.S. Pat. No. 4,456,258 would be hazardous to catch unless made of a soft material. U.S. Pat. No. 4,671,514 (Wilson-Diehl) is far too floppy for easy catching or for convenient playing without the support of a rigid surface. Releasably attachable playing pieces are essential to most portable strategy games. These playing pieces are generally rigid, heavy, and project from the playing surface. The more rigid a piece and the farther it projects from the playing surface, the more likely it is to become snagged and detached during sudden movements of the game. Also, the heavier and more pronounced the playing pieces are, the more likely the pieces are to become detached through sudden accelerations or decelerations, such as by throwing, catching, or dropping the game. Heavy and/or sharp playing pieces and/or playing surfaces further contribute to the possibility of player injury.

SUMMARY OF THE INVENTION

It is, therefore, an object of the present invention to overcome the above drawbacks and to provide a tossable strategy-type game enabling players to interact on a common playing surface without the players being forced to remain in close proximity to one another while the game is in progress.

In accordance with one aspect of the present invention, there is thus provided a tossable strategy-type game comprising a body adapted to be tossed and caught during playing, the body including a playing surface, and a plurality of playing pieces having attachment means for releasably attaching the playing pieces to the playing surface with sufficient strength to retain the playing pieces attached to the surface during tossing and catching while enabling the playing pieces to be manually detached from the surface.

Although it is a feature of the present invention to provide a conveniently tossable strategy-type game playing surface enabling the players to move about bounded only by the distance that the game can be tossed, such a playing surface need not necessarily be tossed to render the game enjoyable. The playing surface can be handed, rolled, bounced, or floated between players in situations where that is more convenient than tossing.

In a preferred embodiment of the strategy-type game according to the invention, the playing pieces each have first attachment means cooperable with second attachment means on the playing surface for releasably attaching the playing pieces to the surface, the first and second attachment means being such as to enable the playing pieces to be peeled off the selected surface.

The present invention also provides, in another aspect thereof, a tossable strategy-type game playing surface which encloses a tri-dimensional body adapted to be tossed and caught during play, the playing surface being divided into distinct areas defining a regular pattern of at least first and second visually distinguishable surface areas such that the first surface areas each have a constant predetermined number of playing paths to adjacent first surface areas.

By the expression "visually distinguishable surface areas" as used herein is meant areas which are readily discernible as different to the unaided eye whether through color, texture, shape, dimension, contour or elevation above or depression below the surrounding surfaces, or through merely being outlined.

The expression "playing path", on the other hand, can be defined as visually discernible interconnections between playing regions, whether the regions are in actual contact or connected with one another, or are spaced from one another by a distance still maintaining an obvious relationship between adjacent playing regions.

As already mentioned, releasably attachable playing pieces are essential to most portable strategy games. When the playing surface is tossable, the attaching strength of the pieces must be sufficient to withstand the rigors of tossing, catching, and being dropped from at least a two-meter fall. Peeling a flexible piece requires far less force for a given attaching strength than prying or pulling a rigid piece from the same surface since a player only must disengage a fraction of the holding surface at one time. Peelable pieces can, therefore, have a much higher attaching strength and still be detached by a human hand without applying undue force.

Particularly preferred embodiments are constructed of a spherical or toroidal body to which sections of pile fasteners are attached. This construction produces lightweight tri-dimensional playing surfaces of a high degree of uniformity to which pile fastener playing pieces can be releasably attached. Spherical or toroidal bodies also have no potentially sharp edges and corners which could injure players during tossing and catching.

The strategy-type game according to the invention, which can be tossed between players, enables the players to move about freely or to occupy comfortable seats and toss the game back and forth while playing. This eliminates the stress of uncomfortable seating and physical immobility that strategy games usually impose upon the players, thus allowing full enjoyment of the game.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF THE PREFERRED EMBODIMENTS

Figure 1:
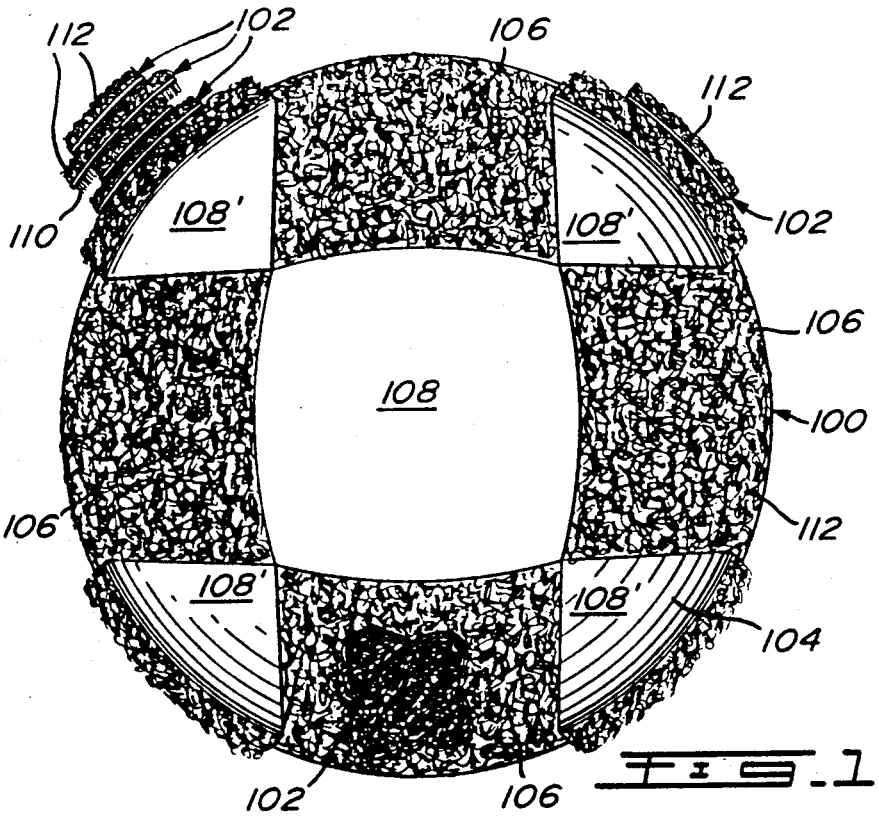
FIG. 1 is a first view of a tossable, tridimensional strategy-type game playing surface with playing pieces thereon, according to a first preferred embodiment of the invention.

Referring first to FIG. 1, there is shown a tossable, tri-dimensional strategy-type game comprising a tri-dimensional playing surface 100 of spherical configuration and a plurality of flexible, oval ring-shaped playing pieces 102 selectively positionable thereon. The playing surface 100 encloses a spherical body 104 made of resilient material, such as an inflated plastic ball, and is divided into a plurality of square surface areas 106 defining playing regions adapted to receive playing pieces 102 thereon, the surface areas 108, 108' defined between the square playing regions 106 constituting non-playing regions, that is, regions on which playing pieces 102 are not positioned.

Size is a significant factor in tossability and playability. The minimum conveniently tossable and playable game size is approximately 1 cm. in radius for simple games. Games smaller than this can be built, but detaching the pieces is awkward and the game becomes harder to toss and catch as well. The maximum limit on practical tossability and playability is approximately 30cm. in radius. Beyond that size it becomes increasingly difficult to toss and catch the game and to hold the game far enough away to study the playing position. In preferred embodiments the radius is between 2 cm. and 12 cm.

The tri-dimensional strategy-type game need not be a sphere but should be cylindrically symmetrical. The radius from the axis of cylindrical symmetry to any point on the playing surface should not exceed by more than 20% the average radius of a cross-section of the surface normal to the axis and passing through the point. Although a preferred shape is a sphere, it is evident that discs, toroids, etc. would be suitable forms for the game.

Weight, of course, is a key factor in the tossability of the tri-dimensional strategy-type game. Heavier bodies and/or pieces put more stress on the attachment means during tossing and catching, and weight beyond a certain point will make the game harder to catch and increase the possibility of injury to the players. Larger bodies forming the game can weigh more than smaller bodies before they become impractical. Empirically it has been found that the maximum weight for any size body would be approximately 500 grams. At 500 grams it has been found that the minimum practical size of a body given a spherical shape would have a radius of 5 cm. Likewise, a 30 cm. radius sphere would have a maximum weight of 500 grams. The minimum weight, however, could be 0 or at least have a neutral buoyancy in the atmosphere, such as a hollow body inflated with lighter-than-air gas to a point to reach a buoyancy equilibrium. Thus, a practical weight range would fall between 0 and 500 grams, keeping in mind that bodies of less than 5 cm. in radius should weigh less than 500 grams The maximum practical weight-to-radius ratio of the bodies having a radius of less than 1 cm. to 2.5 cm. should not exceed 25 g/cm. and 125 g/cm.–250 g. for bodies having a radius of between 2.5 cm. and 6 cm. In the preferred range, the weight to radius ratio is 10 to 20 g/cm. while the size in the preferred range of radius is 2 to 12 cm.

The body should not be floppy to the point of a rag doll, and it could be relatively rigid. The body should be firm enough to be supported by one hand while the playing pieces are being detached or reattached with the other hand. The body should be robust enough to survive a 2 meter drop onto a sharp projection having a 0.5 cm. radius with minimum damage to the body. Preferably the deformation of the body, when dropped from a 2 meter height onto a sharp projection as described above, will not exceed ¼ the thickness of spherical body having a playing surface was made from a blow molding process using a K-Resin KR03NW (a trade mark of Philips 66). The radius of the sphere was 6.3 cm. while the weight was 125 g. with the playing pieces thereon. In a drop test from 2 meters onto a sharp projection having a radius of 0.5 cm., the deformation was 0.25 cm. or 2%. In another example, the material was EVA (ethylene vinyl acetate), the radius was 6.3 cm., and the weight was 145 g. with the playing pieces thereon. In a drop test from 2 meters onto a sharp projection having a radius of 0.5 cm., the deformation was 10 to 15%.

As shown, each square playing region 106 has two neighboring square non-playing regions 108 (only one shown) and two neighboring triangular non-playing regions 108', the playing and non-playing regions 106 and 108, 108' defining a checkerboard pattern. Each corner of any given square playing region 106 contacts the corner of an adjacent square playing region 106 to thereby define a playing path between such regions. Since each playing region 106 has four adjacent playing regions, the number of playing paths from any given playing region to adjacent playing regions is thus equal to the number of adjacent playing regions.

The playing pieces 102 are each provided with hook fasteners 110 engageable with loop fasteners 112 provided on each playing region 106 so as to be releasably retained on selected playing regions 106 when positioned thereon. In order to increase the variety of games that can be played on the surface 100, each playing piece 102 is further provided on its top with loop fasteners 112 such as to enable a plurality of playing pieces 102 to be releasably attached one on top of another to provide a flexible stack of playing pieces releasably attached to a selected playing region 106. The hook and loop fasteners 110, 112, which are utilized as cooperable attachment means, are available under the trade mark "Velcro".

Figure 2:
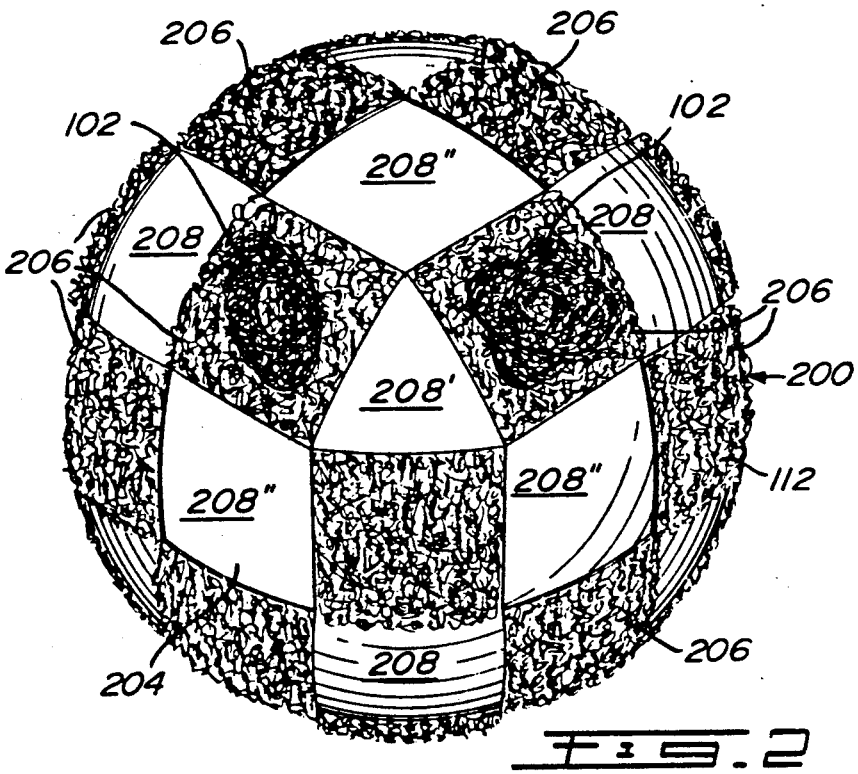
FIG. 2 is a view similar to that of FIG. 1, illustrating a second preferred embodiment according to the invention.

In the embodiment illustrated in FIG. 2, the playing surface 200, which also encloses a spherical body 204, has twenty-four square playing regions 206 provided with loop fasteners 112, instead of twelve as in FIG. 1. As shown, each square playing region 206 has one neighboring square non-playing region 208, one neighboring triangular non-playing region 208', and two neighboring rhombic or diamond-shaped non-playing regions 208''. The playing regions 206 also each have a number of adjacent playing regions which is the same as the number of playing paths thereto, namely, four.

Figure 3:
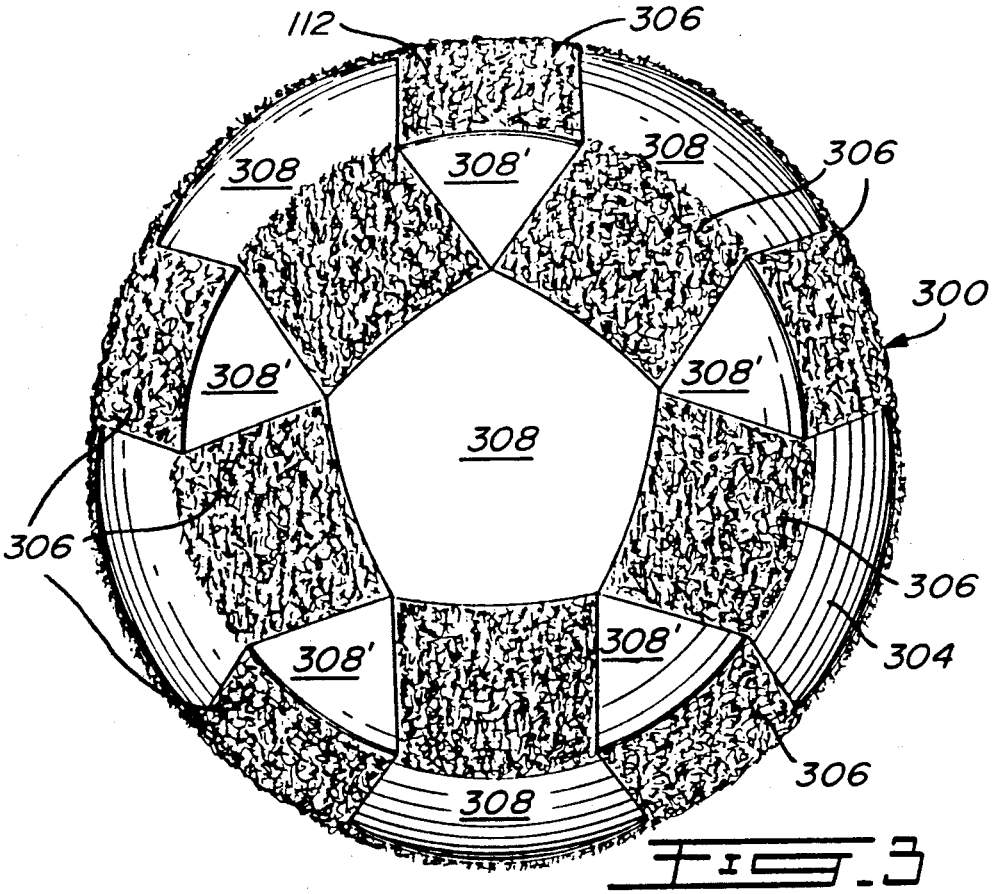
FIG. 3 is another front view illustrating a tossable, tri-dimensional strategy-type game playing surface according to a third preferred embodiment of the invention.

The tri-dimensional playing surface 300 illustrated in FIG. 3 also encloses a spherical body 304, but comprises thirty square playing regions 306 provided with loop fasteners 112. Each square playing regions 308 and two neighboring triangular non-playing regions 308'. As in the embodiments of FIGS. 1 and 2, each playing region 306 has the same number of adjacent playing regions as the number of playing paths thereto, namely, four.

Figure 4:
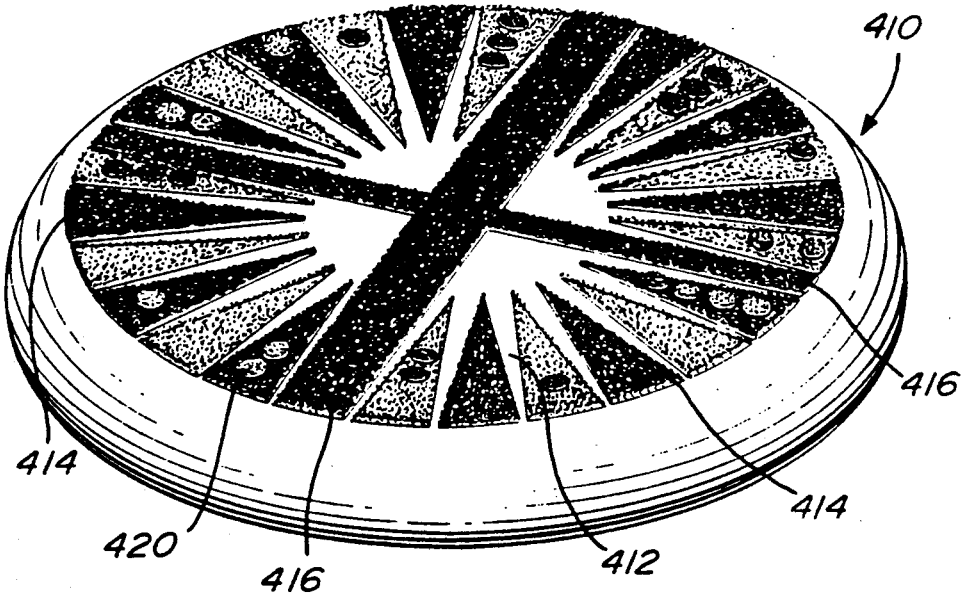
FIG. 4 is a perspective view of a further embodiment of the present invention.

The embodiment shown in FIG. 4 includes a "Frisbee" (a trade mark of Kransco) type saucer-shaped body. The body 410 includes a flat top surface 412 on which a backgammon playing surface has been provided. The backgammon game includes triangular loop fastener strips 414 and bands 416, 418 with soft peelable playing pieces 420 having loop fasteners.

We claim:

1. A tossable game comprising:

a body on which there is a playing surface, to be tossed and caught during play, said body having a radius R range of between 1 cm. to 30 cm.; a weight not exceeding 500 g/cm. for a radius R range of 6 cm. to 30 cm., whereas the weight-to-radius ratio does not exceed 25 g/cm. for an R range of 1 cm. to 2.5 cm. and 125 g/cm.–250 g. for an R range of 2.5 to 6 cm.; the body being cylindrically symmetrical and the radius from the axis of cylindrical symmetry to any point on the playing surface does not exceed by more than 20% the average radius R of a cross-section of the surface normal to the axis and passing through the point;

the body having a degree of deformation which does not exceed one quarter ($\frac{1}{4}$) the thickness of the body in the direction of motion when the body is dropped from a height of 2 meters onto a sharp projection having a radius of 0.5 cm.;

a plurality of playing pieces, said playing pieces each having attachment means for being releasably attached to said playing surface with sufficient strength to be retained on said playing surface during tossing while enabling said playing pieces to be manually detached from said playing surface.

2. A strategy-type game as claimed in claim 1, wherein said body has a substantially spherical configuration.

3. A strategy-type game as claimed in claim 1, wherein said playing pieces are flexible and each have first attachment means cooperable with second attachment means on said playing surface for releasably attaching said playing pieces to said playing surface, and wherein said first and second attachment means and playing piece flexability are such as to enable said playing pieces to be peeled off said playing surface.

4. A strategy-type game as claimed in claim 3, wherein said first and second attachment means comprise a plurality of first and second magnetic members adhered respectively to said playing pieces and to said playing surface.

5. A strategy-type game as claimed in claim 3, wherein said playing pieces each have two sides facing opposite directions and are each provided on one side with said first attachment means and on the other side with said second attachment means, whereby a plurality of playing pieces can be releasably attached one on top of another to provide a stack of playing pieces releasably attached to said playing surface.

6. A tossable game as claimed in claim 1, wherein the body has a maximum radius of between 2 cm. and 12 cm.

7. A tossable game as claimed in claim 6, where the mass to radius ratio is between 10 and 20 g/cm.

8. A tossable game as claimed in claim 1, wherein the body is in the form of a tossable saucer-shaped missile.

* * * * *